US005462457A

United States Patent [19]

Schroepfer et al.

[11] Patent Number: 5,462,457

[45] Date of Patent: Oct. 31, 1995

[54] OVERMOLD STRAIN RELIEF AND SNAG PREVENTION FEATURE

[75] Inventors: Richard C. Schroepfer, Thompsontown; Edward E. Knisely, Jr., Middletown, both of Pa.

[73] Assignee: The Whitaker Corporation, Wilmington, Del.

[21] Appl. No.: 310,553

[22] Filed: Sep. 22, 1994

[51] Int. Cl.[6] ..... H01R 13/405

[52] U.S. Cl. ..... 439/736; 439/352; 439/447

[58] Field of Search ..... 439/352, 353, 439/445, 447, 452, 736, 278, 283, 606

[56] References Cited

U.S. PATENT DOCUMENTS

| | | | |
|---|---|---|---|
| 3,850,497 | 11/1974 | Krumreich et al. | 339/126 R |
| 4,586,776 | 5/1986 | Ollis et al. | 339/105 |
| 4,611,875 | 9/1986 | Clarke et al. | 339/154 A |
| 4,685,758 | 8/1987 | Yoshida | 439/606 |
| 4,703,989 | 11/1987 | Price et al. | 439/283 |
| 4,834,487 | 5/1989 | Abendschein et al. | 350/96.20 |
| 4,917,617 | 4/1990 | Smith | 439/278 |
| 5,203,715 | 4/1993 | Yamamoto | 439/354 |
| 5,232,378 | 8/1993 | Weingartner | 439/354 |
| 5,254,014 | 10/1993 | Yagi et al. | 439/353 |
| 5,334,044 | 8/1994 | Falossi et al. | 439/676 |

OTHER PUBLICATIONS

Federal Register, Jul. 12, 1976, pp. 28694–28735.

*Primary Examiner*—David L. Pirlot
*Assistant Examiner*—Jill DeMello
*Attorney, Agent, or Firm*—Kevin D. McCarthy

[57] ABSTRACT

An electrical cable assembly (1) comprises, an electrical connector (2) terminated to an electrical cable (3), an insulating housing (4), a moveable latch (5) on the connector (2) for latching removably to another mating electrical connector, and an overmold (8) adhered to the housing (4) and at least partially overlapping a portion of the moveable latch (5) to prevent snagging of the latch (5).

9 Claims, 4 Drawing Sheets

OVERMOLD STRAIN RELIEF AND SNAG PREVENTION FEATURE

FIELD OF THE INVENTION

The invention relates to an electrical cable assembly, and, more specifically, to an electrical cable assembly with a moveable latch that has a tendency to snag against wires and other devices.

BACKGROUND OF THE INVENTION

U.S. Pat. No. 3,850,497 discloses an electrical cable assembly with a moveable latch on an electrical connector adapted to move and latch removably to another mating connector. The latch comprises, an uncovered projection that is susceptible to snag on other cable assemblies other devices, and, thereby, promotes tangling of the cable assembly with other cable assemblies and devices.

An overmold is an insulative body that is formed by molding an insulative material onto a cable assembly comprising, an electrical connector and an electrical cable terminated with the electrical connector. It is known from U.S. Pat. No. 4,586,776 to provide an overmold directly to a cable assembly and provide a molded strain relief for the cable assembly. The overmold has an interior that adheres to an external surface of the cable. No air pocket is between the overmold and the cable. The absence of an air pocket is advantageous to promote a sturdy connection of the overmold. Accordingly, the overmold has not heretofore been constructed purposely with a useful air pocket.

SUMMARY OF THE INVENTION

According to the invention, an overmold provides a useful feature that at least partially covers a latch on an electrical connector to prevent snagging of the latch. An advantage of the invention resides in a snag prevention feature provided by an overmold adhered to an electrical connector.

According to an embodiment the invention, an overmold incorporates a snag prevention feature, and fills cavities in an electrical connector to improve electrical insulation. According to an embodiment of the invention, an overmold incorporates a snag prevention feature, and fills cavities in an electrical connector to improve electrical insulation, and reinforces a cable strain relief.

According to an embodiment of the invention, an overmold incorporates both a snag prevention feature and a strain relief. An advantage of the invention resides in a combination of a snag prevention feature and a strain relief feature, both features being formed by an overmold. Another advantage resides in a strain relief and a snag prevention feature combined with an overmold that adheres to an electrical connector, and adheres to an electrical cable terminated with the connector.

According to an embodiment of the invention, an overmold is provided on an electrical cable assembly to provide a strain relief, and to overlap at least a portion of a moveable latch on a connector to prevent snagging of the latch.

DESCRIPTION OF THE DRAWINGS

Embodiments of the invention will now be described by way of example with reference to the accompanying drawings, according to which;

With reference to FIG. 1, an electrical cable assembly 1 comprises, an electrical connector 2 and an electrical cable 3 terminated with the connector 2. The connector 2 comprises, an insulating housing 4 and a moveable latch 5 on the connector 2 adapted to latch removeably to another mating connector, not shown. Further not shown are electrical contacts in contact receiving cavities 6 of the housing 4 that are connected in a known manner to respective wires, not shown, of the cable 3. According to this embodiment of a connector 2, the latch 5 on the connector 2 is fabricated as being unitary with the housing 4. Further details of this embodiment of a connector 2 with a unitary latch 5 are described in Report And Order of the Federal Communications Commission, published in the *Federal Register,* Jul. 12, 1976, Pages 28694–28735, approved for use in the National Telephone System, U.S.A. According to another embodiment, not shown, the latch 5 on the connector 2 can be a separate part that is attached to the connector 2. According to yet another embodiment disclosed in U.S. Pat. No. 4,586,776, the latch 5 is formed by an overmold.

With reference to FIGS. 2–4, a disadvantage of the latch 5 resides in the latch 5 projecting outwardly from the connector 2, and an end 7 of the latch 5 being susceptible to snag on strands of wires, not shown, and other devices, not shown. For example, the cable assembly 1 is used in a space that is crowded with other wires where tangling needs to be avoided. Further, for example, the cable assembly 1 is bundled together for shipment with multiple other like cable assemblies. The latch 5 on one cable assembly 1 tends to snag on the other cable assemblies, causing tangling of the cable assemblies.

With reference to FIGS. 1–4, there is disclosed an overmold 8 adhered to the housing 4 and at least partially overlapping a projecting portion 9 of the moveable latch 5 that projects out of the overmold 8 to prevent snagging of the latch 5. The overmold 8 provides a tapered strain relief 10 with multiple series of ribs 11 and a snag prevention feature 12 for the latch 5 on the connector 2.

Figure 1:
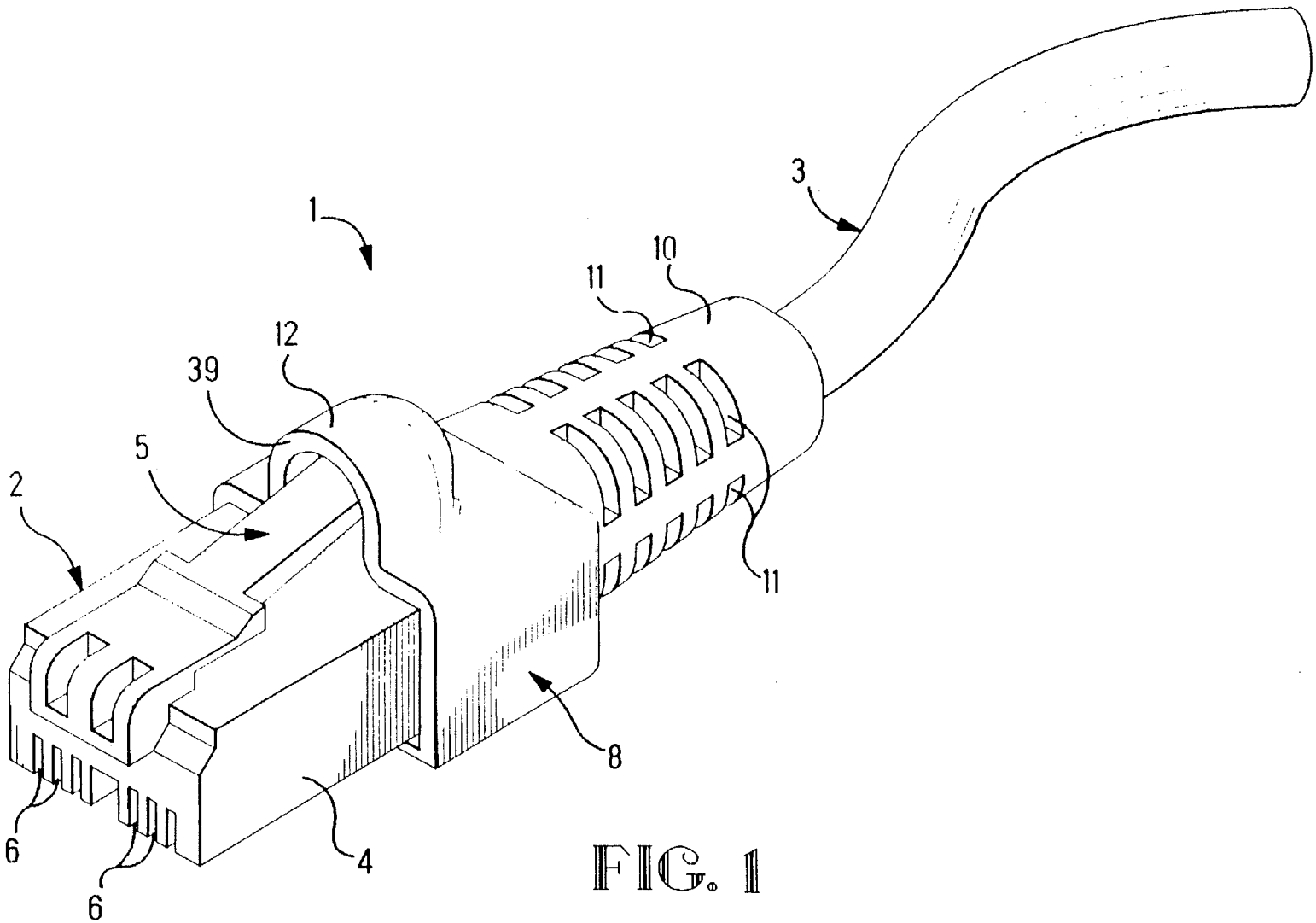
FIG. 1 is an isometric view of an electrical cable assembly with an overmold.

The strain relief 10 of the overmold 8 adheres to the housing 4 and to the cable 3. The snag prevention feature 12 comprises, for example, a pocket 12 on the strain relief 10 that at least partially receives the latch 5. The pocket 12 bulges outwardly from the housing 4 to provide an interior space 13. The latch 5 extends into the interior space 13. The pocket 12 covers the end portion 7 of the latch 5 that can hook onto external objects, not shown. The pocket 12 is externally tapered by virtue of a dome shape to prevent snagging.

Figure 3:
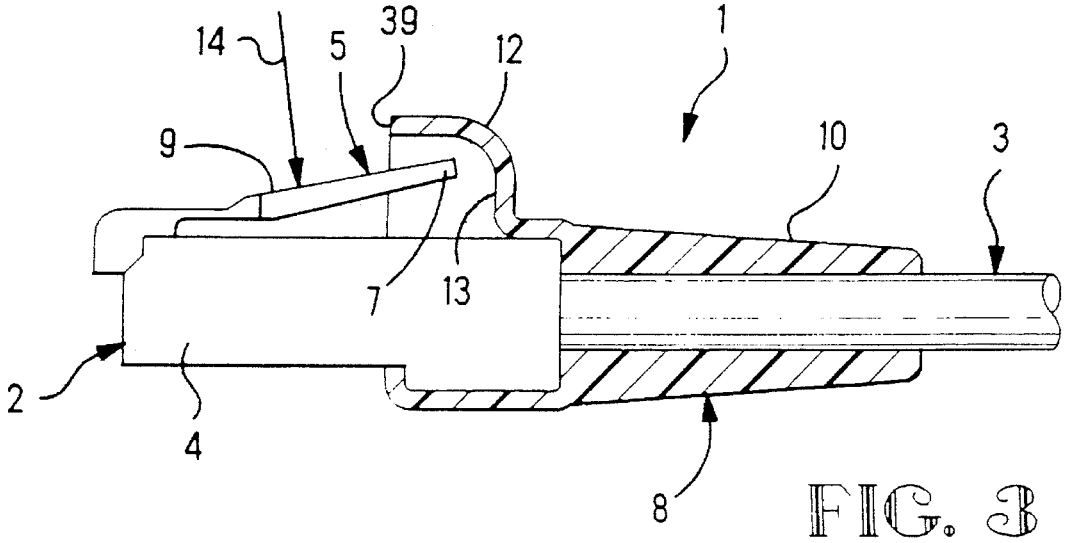
FIG. 3 is a view similar to FIG. 2 with parts cut away.
Figure 4:
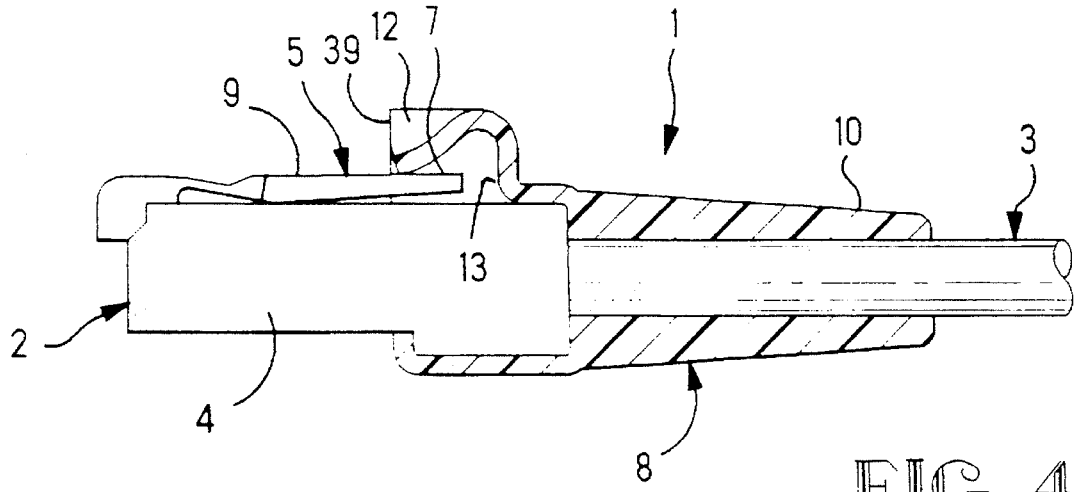
FIG. 4 is a view similar to FIG. 3 illustrating deflection of a moveable latch and deflection of a snag prevention feature.

With reference to FIG. 3, the portion 9 of the latch 5 projects from the pocket 12 for being moved by manual actuation, when a force is applied to the latch 5 as indicated by the arrow 14. With reference to FIG. 4, the latch 5 is resiliently deflectable by manual actuation, and the pocket 12 is adapted for resilient deflection together with deflection of the latch 5. The dome shape of the pocket 12 is deformed by resilient deflection. The pocket 12 is formed of a material with memory to restore the dome shape after being deflected.

Figure 5:
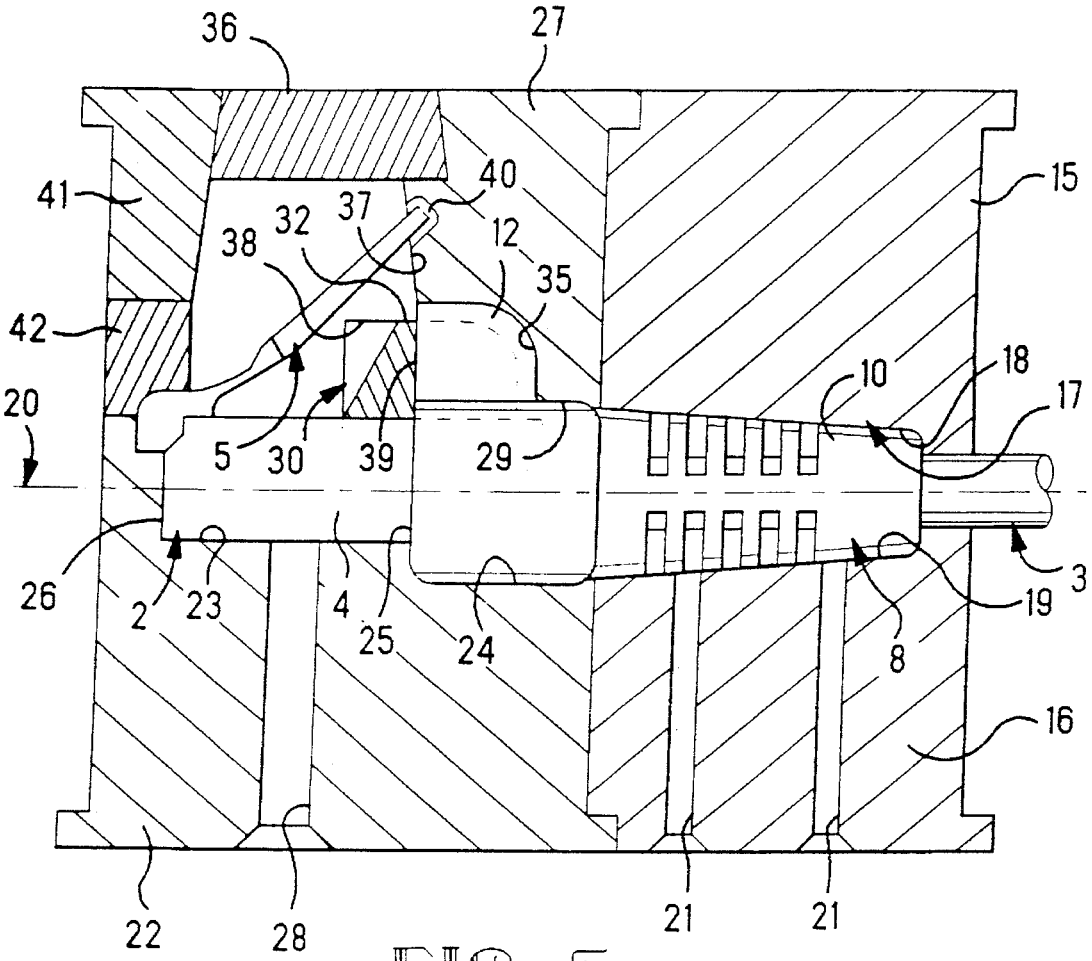
FIG. 5 is an elevation view with parts shown cut away of molding die inserts applying an overmold to the cable assembly shown in FIG. 1.

With reference to FIG. 5, manufacture of the overmold 8 will now be described. A first molding die insert 15 and a second molding die insert 16 are manufactured with a common molding cavity 17 that extends in each of the molding dies 15, 16, and comprises, a first cavity portion 18 and a second cavity portion 19. The first cavity portion 18 in the first molding die insert 15 receives a portion of the cable 3, and is shaped to mold the overmold 8 into a top one-half of the strain relief 10 adhered on an exterior surface of the cable 3. The second cavity portion 19 in the second molding die insert 16 receives a portion of the cable 3, and is shaped to mold the overmold 8 into a bottom one-half of the strain relief 10 adhered on an exterior surface of the cable 3. The two halves of the strain relief 10 are formed simultaneously during a molding operation. The molding die inserts 15, 16 are inserted in a known molding apparatus, not shown. The molding die inserts 15, 16 meet each other along a mold parting line 20, FIG. 5, that intersects the axis of the cable 3 and the centerline of the strain relief 10. Knock out passages 21 extend through the second molding die insert 16, along which passages 21 respective knock out pins, not shown, impel against the strain relief 10, after the die inserts 15, 16 separate, subsequent to molding the strain relief 10, to eject the strain relief 10 and the cable 3 from the second molding die insert 16.

A third molding die insert 22 interlocks with the second die insert 16 and accompanies the second molding die insert 16 in the known molding apparatus, not shown. A third cavity portion 23 of the cavity 17 is in the third molding die insert 22 that receives a portion of the housing 4 of the connector 2. An interior 24 of the third cavity portion 23 is shaped to mold fluent molding material into a bottom one-half of the overmold 8 adhered on an exterior surface of the housing 4 of the connector 2.

The third cavity portion 23 is reduced in size forward of a front end 25 of the overmold 8, and nests the housing 4 of the connector 2 therein to form a shut off that forms the front end 25 of the overmold 8. The front end 25 of the overmold 8 is receded from a front end 26 of the housing 4 of the connector 2, allowing the front end 26 of the connector 2 to enter into a jack type mating connector, not shown, of the type disclosed in U.S. Pat. No. 3,850,497, and further disclosed in the Report And Order of the Federal Communications Commission, published in the *Federal Register*, Jul. 12, 1976, Pages 28694–28735, approved for use in the National Telephone System, U.S.A.

A fourth molding die insert 27 interlocks with the first molding die insert 15 and accompanies the first molding die insert 15 in the known molding apparatus, not shown. The third molding die insert 22 and the fourth molding die insert 14 meet each other above the mold parting line, 20. A knock out passage 28 extends through the third molding die insert 22, along which passage a respective knock out pin, not shown, impels against the connector 2, after the die inserts 15, 16 separate subsequent to molding the overmold 8, to eject the connector 2 and the overmold 8 from the third molding die insert 27. A fourth cavity portion 29 of the mold cavity 17 extends in the fourth die insert 27.

Figure 6:
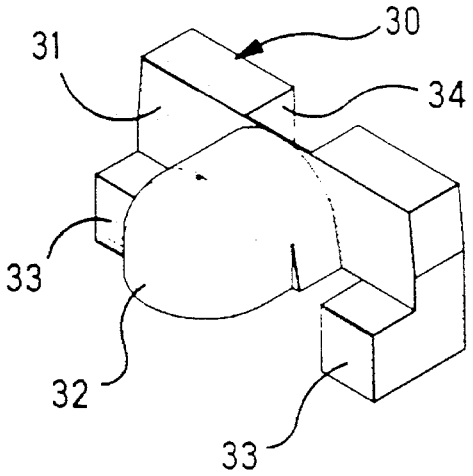
FIG. 6 is an isometric view of a core pin.
Figure 7:
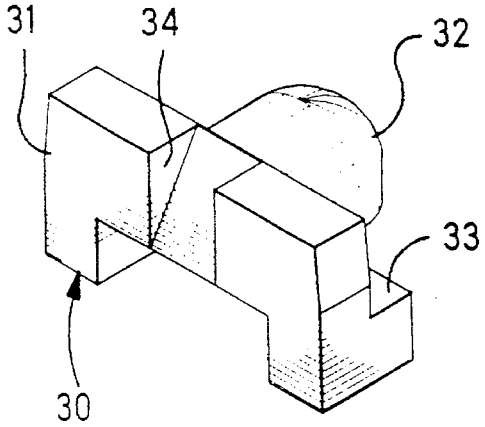
FIG. 7 is another isometric view of the core pin shown in FIG. 6.

Details of a core pin 30 will be described with reference to FIGS. 6 and 7. The core pin 30 is of unitary construction, and has a central flange 31, a dome 32 extending rearward of the flange 31, and a pair of arms 33 extending rearward of the flange 31 and being laterally spaced from the dome 32. An inclined recess 34 in a front of the flange 31 is aligned with the dome 32. With reference to FIG. 5, the core pin 30 extends into the fourth die insert 27 with the arms 33 being held by the fourth die insert 27. The dome 32 is received part way into the fourth cavity portion 29 in the fourth molding die insert 27. An interior 35 of the fourth cavity portion 29 has a dome shape that is spaced from the dome 32 on the core pin 30. In the interior 35 the pocket 12 is formed by fluent molding material. The interior 35 of the fourth cavity portion 29 opens into the interior of the third cavity portion 23, and is spaced from a portion of the housing 4 of the connector 2 to mold fluent molding material to form a top portion of the overmold 8 adhered on an exterior surface of the housing 4 of the connector 2. The top and the bottom portions of the overmold 8 are simultaneously formed in the mold cavity 17.

With reference to FIG. 5, a boot insert 36 is combined with the fourth molding die insert 27. An exterior surface 37, FIG. 8, on the boot insert 36 closes against the die insert 27. An interior surface on the boot insert 36 has an arched opening 38 that closes against the dome 32 on the core pin 30, where the dome 32 meets the flange 31, and forms a front end 39 of the pocket 12. A slotted opening 40 in the boot insert 36 is aligned with the inclined recess 34 in the core pin 30 and provides a clearance for receiving the latch 5. The boot insert 36 receives a top portion of the housing 4.

With reference to FIG. 5, a pinch insert 41 is received in an inset 42 of the boot insert 36 to provide a hold down that holds the boot insert 36 in position.

When the molding dies close, they enclose the cavity 17, by movement toward and in abutment with each other, along the parting line 20. Plastic material in a fluent state is injected into the enclosed cavity 17. Fluent plastic material fills the enclosed cavity 17 and is solidified to form the overmold 8, while the core pin 30 forms the pocket 12. During solidification, the plastic material adheres to the housing 4. The melting temperature of the housing 4 is substantially above the fluent temperature of the fluent plastic material that forms the overmold 8. For example, the material of the housing 4 is Nylon. The plastic material that forms the overmold 8 is a polyvinylchloride or Polyether Block Polyamide Copolymer. After solidification of the plastic material, the molding die inserts 15 and 27 move away from the die inserts 16 and 22, not shown, in a direction transverse to the parting line 20. The connector 2 and the overmold 8, together with the core pin 30, are ejected from the molding die inserts 16 and 22, according to an operation performed by known molding machinery.

Figure 8:
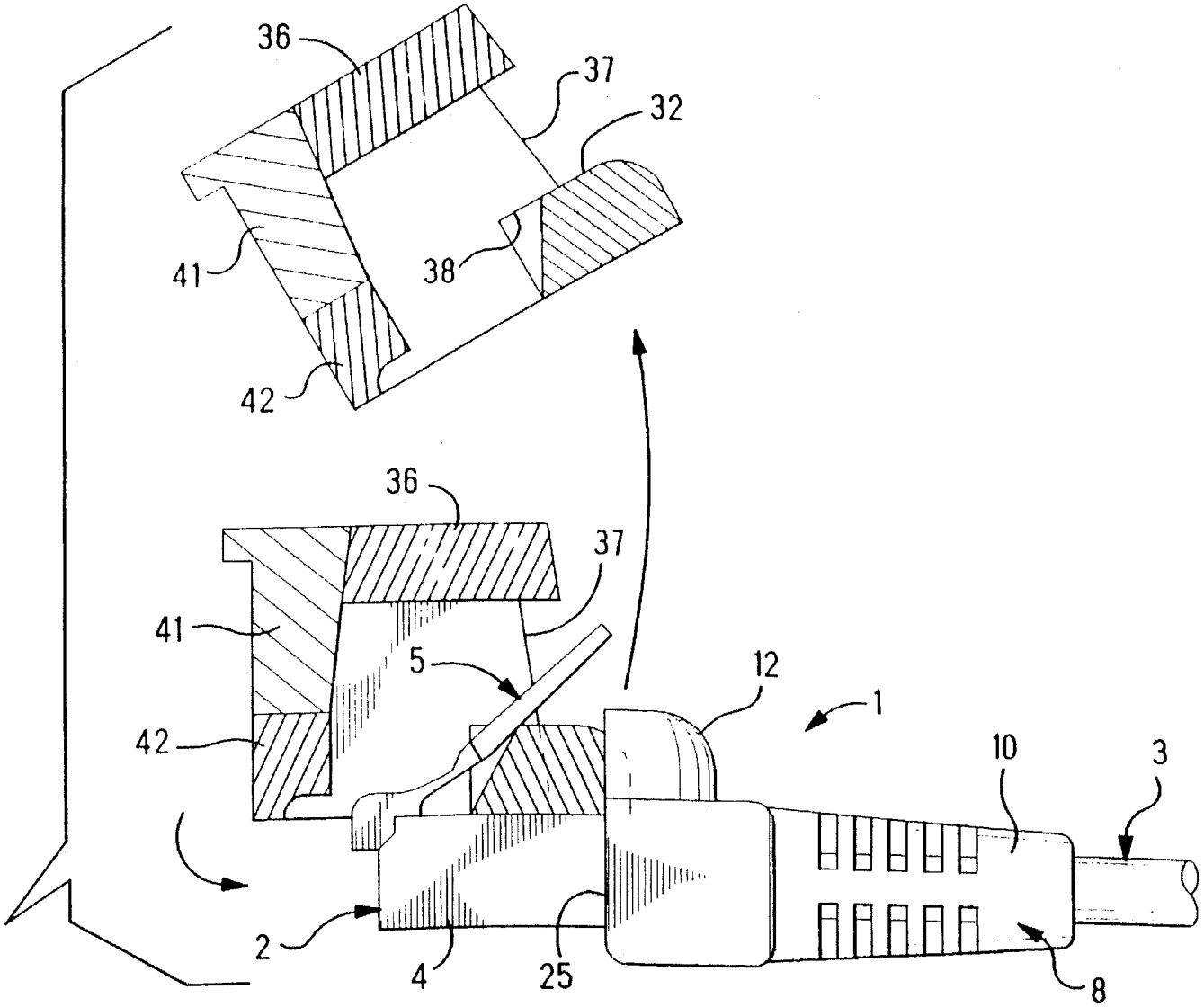
FIG. 8 is an elevation view with parts shown cut away to illustrate removal of a core pin and portions of molding die inserts.

With reference to FIG. 8, the core pin 30 is removed from the overmold 8 and the connector 2, by pivoting the core pin 30. During the molding operation, the core pin 30 is installed against the latch 5. The latch 5 is held by the core pin 30 in a position that points the latch 5 away from the cavity 17 when the molding dies close. The latch 5 is deflected and held out of the way by the core pin 30 while the overmold 8 is fabricated in the cavity 17 as described.

Figure 2:
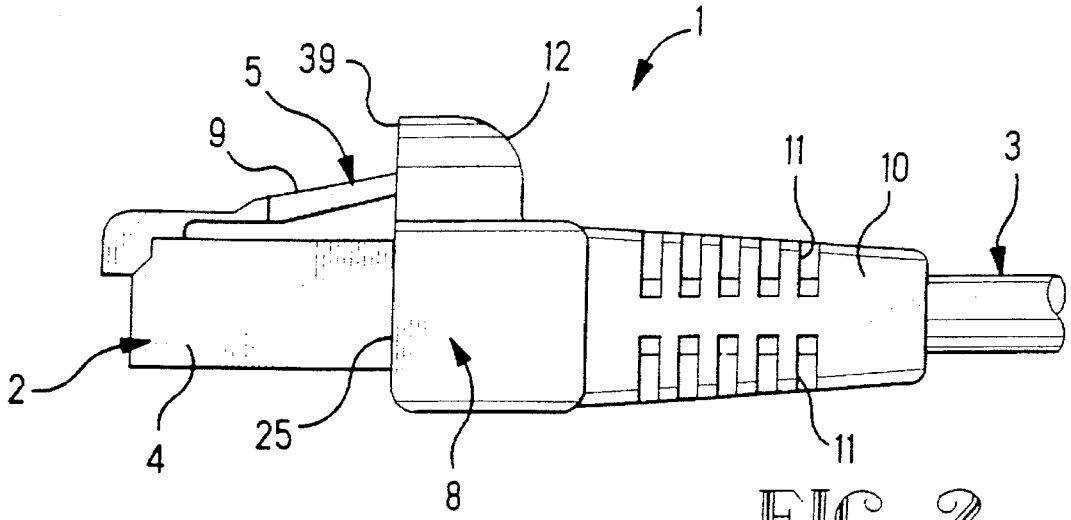
FIG. 2 is an elevation view of the structure shown in FIG. 1.

According to the embodiment of the overmold 8 as in FIGS. 2–4, the overmold 8 comprises the strain relief 10. The unitary overmold 8 unifies the strain relief 10 and the pocket 12. The cavity portions 18, 19, 23, 24, 29 and 35 in the respective molding die inserts 15, 16, 22 and 27 receive respective portions of an electrical cable 3 and the connector 2. The cavity portions 18, 19 are shaped to mold a strain relief 10 having an exterior taper and the transverse ribs 11 in the strain relief 10. The strain relief 10 adheres to the cable 3 and to a rear portion of the housing 4. The cavity portions 23, 24, 29 and 35 in the respective molding die inserts 22 and 27 receive respective portions of the housing 4 of the connector 2. The cavity portions 23, 24, 29 and 35 are shaped to mold the pocket 12 and the overmold 8 that adheres to the housing 4. Subsequent to the molding operation, the pocket 12 is stretched resiliently more open. The latch 5 is pivoted toward the pocket 12 and into the interior of the pocket 12. The pocket 12 returns to its prior, unstretched shape by resilient shape recovery.

An advantage of the invention resides in an overmold that comprises a strain relief and a snag prevention feature for a cable assembly.

Another advantage of the invention resides in a method of molding a unitary overmold that adheres to a connector terminating an electrical cable to provide a strain relief and a snag prevention feature for a latch on the connector.

Although an embodiment of each invention is disclosed, other embodiments and modifications are intended to be covered by the spirit and scope of the appended claims.

The invention claimed is:

1. An electrical cable assembly comprising: an electrical connector terminating an electrical cable, an insulating housing of the connector, a moveable latch on the connector for latching removably to another mating electrical connector, an overmold formed on a part of the housing, the overmold adheres to the housing and has a strain relief pocket that at least partially overlaps a portion of the moveable latch to prevent snagging of the latch, said strain relief pocket having an inwardly deflectable wall.

2. An electrical cable assembly as recited in claim 1 wherein, the overmold comprises a strain relief adhering to the housing and to the cable.

3. A cable assembly as recited in claim 1 wherein, an end of the latch is in the pocket.

4. A cable assembly as recited in claim 1 wherein, a portion of the latch projects from the strain relief pocket for being moved by manual actuation.

5. A cable assembly as recited in claim 1 wherein, a strain relief pocket on the strain relief at least partially receives the latch.

6. A cable assembly as recited in claim 1 wherein, a strain relief pocket on the strain relief covers a hook portion of the latch, and a portion of the latch projects from the strain relief pocket for being moved by manual actuation.

7. A cable assembly as recited in claim 1 wherein, a strain relief pocket on the overmold at least partially receives the latch, the pocket being externally tapered and extending over a hook portion of the latch, and an open end on the strain relief from which a portion of the latch projects for being moved by manual actuation.

8. A cable assembly as recited in claim 1 wherein, a strain relief pocket on the strain relief at least partially receives the latch, the latch being resiliently deflectable by manual actuation, and the strain relief being adapted for resilient deflection together with deflection of the latch.

9. A cable assembly as recited in claim 1 wherein, a strain relief pocket on the strain relief bulges outwardly from the housing to provide an interior space, and the latch extends into the interior space.

* * * * *